United States Patent [19]

Wudtke

[11] 4,354,608

[45] Oct. 19, 1982

[54] MOTION COMPENSATOR AND CONTROL SYSTEM FOR CRANE

[75] Inventor: Donald J . Wudtke, Mount Vernon, Wash.

[73] Assignee: Continental Emsco Company, Dallas, Tex.

[21] Appl. No.: 46,748

[22] Filed: Jun. 8, 1979

[51] Int. Cl.[3] ..... B66C 23/52; B63B 27/00

[52] U.S. Cl. ..... 212/191; 212/192; 212/190; 212/256; 414/137; 414/139; 254/264

[58] Field of Search ..... 212/190; 414/137, 139; 254/264; 114/205, 213–215, 259–260

[56] References Cited

U.S. PATENT DOCUMENTS

| | | | |
|---|---|---|---|
| 2,961,216 | 11/1960 | Blair | 254/172 |
| 3,240,353 | 3/1966 | Leavesley | 212/48 |
| 3,309,065 | 3/1967 | Prud'Homme et al. | 254/172 |
| 3,512,657 | 5/1970 | Chambers | 414/139 |
| 3,718,316 | 2/1973 | Lairalde et al. | 254/172 |
| 3,871,527 | 3/1975 | Schimmeyer et al. | 212/3 R |
| 4,007,826 | 2/1977 | Brown, Jr. et al. | 414/139 |
| 4,098,082 | 7/1978 | Packer | 254/172 |
| 4,155,538 | 5/1979 | Claassen | 212/3 R |

FOREIGN PATENT DOCUMENTS

| | | | |
|---|---|---|---|
| 212505 | 5/1960 | Austria | 212/146 |
| 280781 | 12/1964 | Netherlands | 254/172 |
| 153781 | 11/1963 | U.S.S.R. | 212/197 |

*Primary Examiner*—Trygve M. Blix

*Assistant Examiner*—R. B. Johnson

*Attorney, Agent, or Firm*—M. H. Gay

[57] ABSTRACT

A motion compensation system for a crane hoist serves to assist the crane operator in safely lifting loads from the deck of a heaving work boat. The crane hook follows the motion of the load because a level of pre-tension is maintained on the line by use of a counterweight connected to the reeving system. A hydraulic cylinder connected to the counterweight provides for locking movement of the counterweight and also provides a cushion at both ends of its travel. Movement of the piston in the cylinder is controlled by a system including a check valve controlling flow between opposite ends of the cylinder which permits the reeving system to take up line. A limit switch responds to movement of the piston and counterweight near the top of their travel to actuate a light to warn the operator of a need to pay out line. As the piston and counterweight approach the bottom of their travel which indicates the load is moving upward, another limit switch actuates a light to indicate time to lift the load. A relief valve in parallel with the operator-controlled switch responds to excessive load to permit more line to be paid out. A separate pressure-responsive switch responds to normal working pressure in the rod end of the cylinder to prevent line from being paid out even though the operator might inadvertently provide an input to the operator-controlled switch.

8 Claims, 7 Drawing Figures

MOTION COMPENSATOR AND CONTROL SYSTEM FOR CRANE

BACKGROUND OF THE INVENTION

There are many situations in which it is desired to operate a crane hoist with means for safely lifting loads from the deck of a heaving work boat with a crane mounted on an offshore vessel, pipe-lay vessel or non-floating platform. This is accomplished by allowing the crane hook to follow the heaving motion of a load on the deck of a work boat at a low level of pre-tension on the hoist cable which also reduces shock loads under full load dynamic conditions. Various means for keeping slack out of the line have been implemented, such as a spring connected between a sheave carrying the line and a stationary point, a counterweight attached to one or more sheaves in the line which continually imposes a pre-tension to take out any slack, various arrangements of line shorteners using hydraulic rams, etc. Control of crane hoists having such compensation means have generally either been expensive and complicated or have relied heavily on the crane operator to judge visually when to lift the load from the heaving deck. This places a heavy burden on the crane operator since any errors in judgment could result in causing the operator to attempt to lift the load at the worst possible instant, such as while the deck is moving downwardly at the same time there is still slack in the line. Pulling up on the load at such an instant could result in a heavy jerk, placing extremely heavy instantaneous loads on the attached cable, derrick boom and other parts of the system. Thus, it would be desirable to provide a relatively simple, reliable and straightforward control system which would assist the crane operator in determining the optimum time to lift the load and which would also operate to avoid the imposition of peak loads even in the case of an attempt to lift the load at an inopportune time.

Figure 3A:
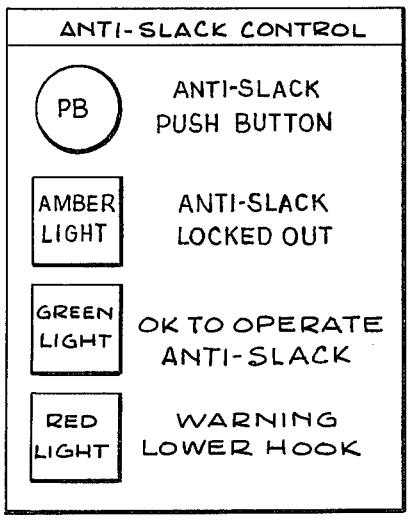
FIG. 3 is a schematic diagram of the motion compensation system of FIG. 1 in combination with a control system therefor, this particular figure showing the control system with valves positioned for normal operation with no load on the hook.
Figure 3:
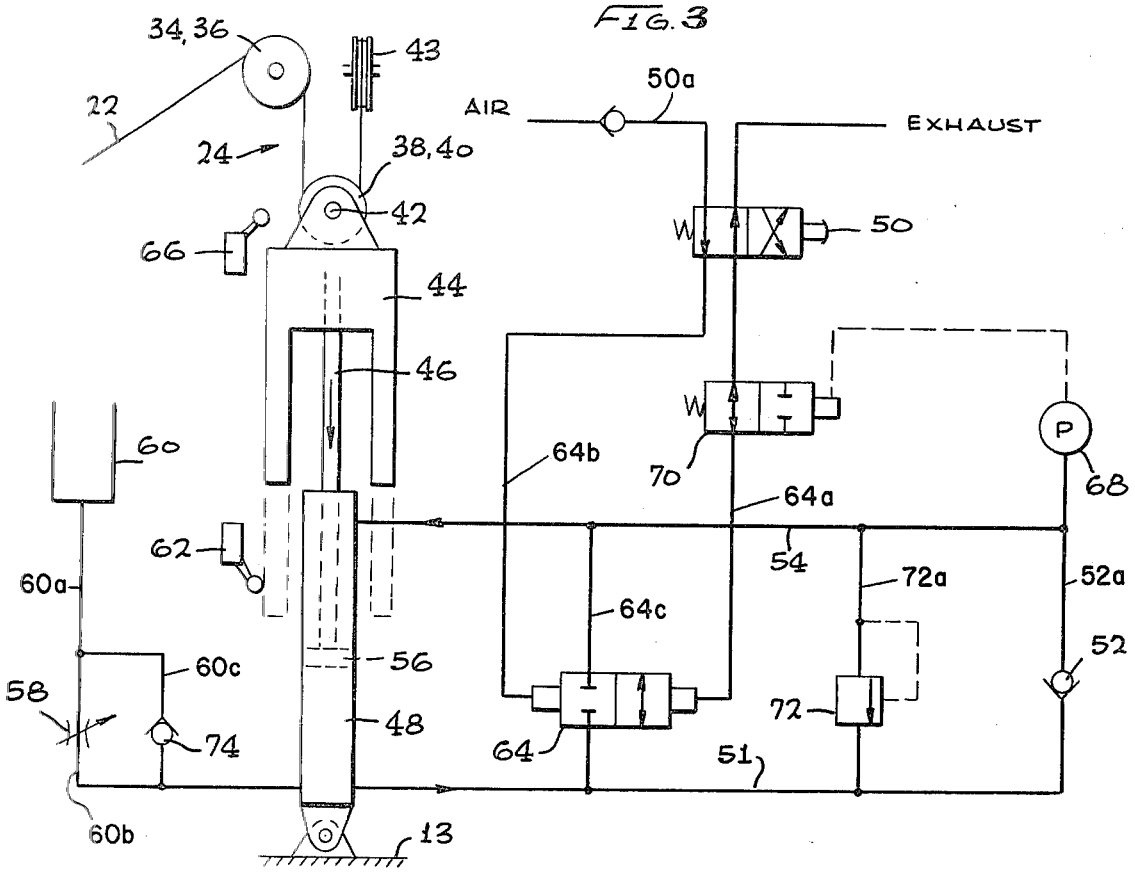

FIG. *3a* is a diagram of a control panel used in combination with the system of FIG. 3.

Figure 4:
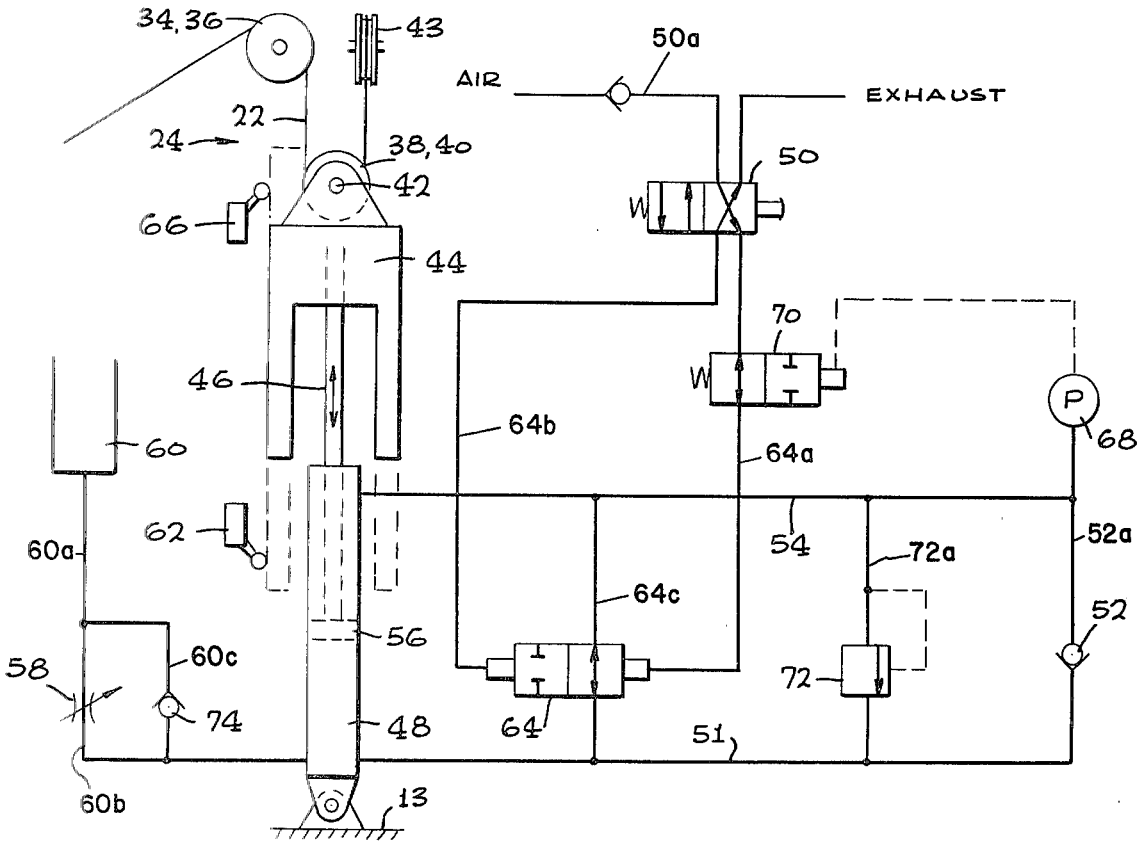

FIG. 4 is a schematic diagram of the motion compensation system and control system of FIG. 3 with the valves positioned to permit the crane hook to follow the load.

Figure 5:
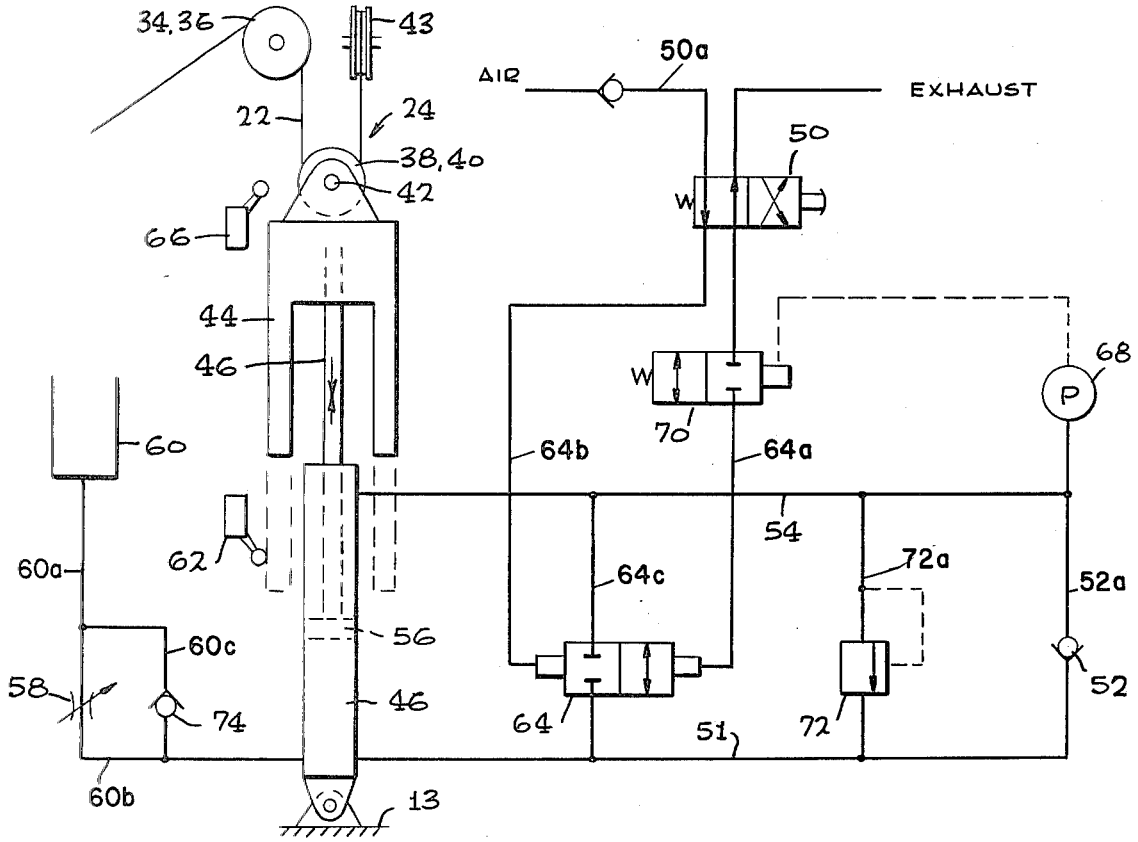

FIG. 5 is a schematic diagram of the motion compensation system and control system of FIG. 3 with the valves positioned to cause the crane to lift the load.

Figure 6:
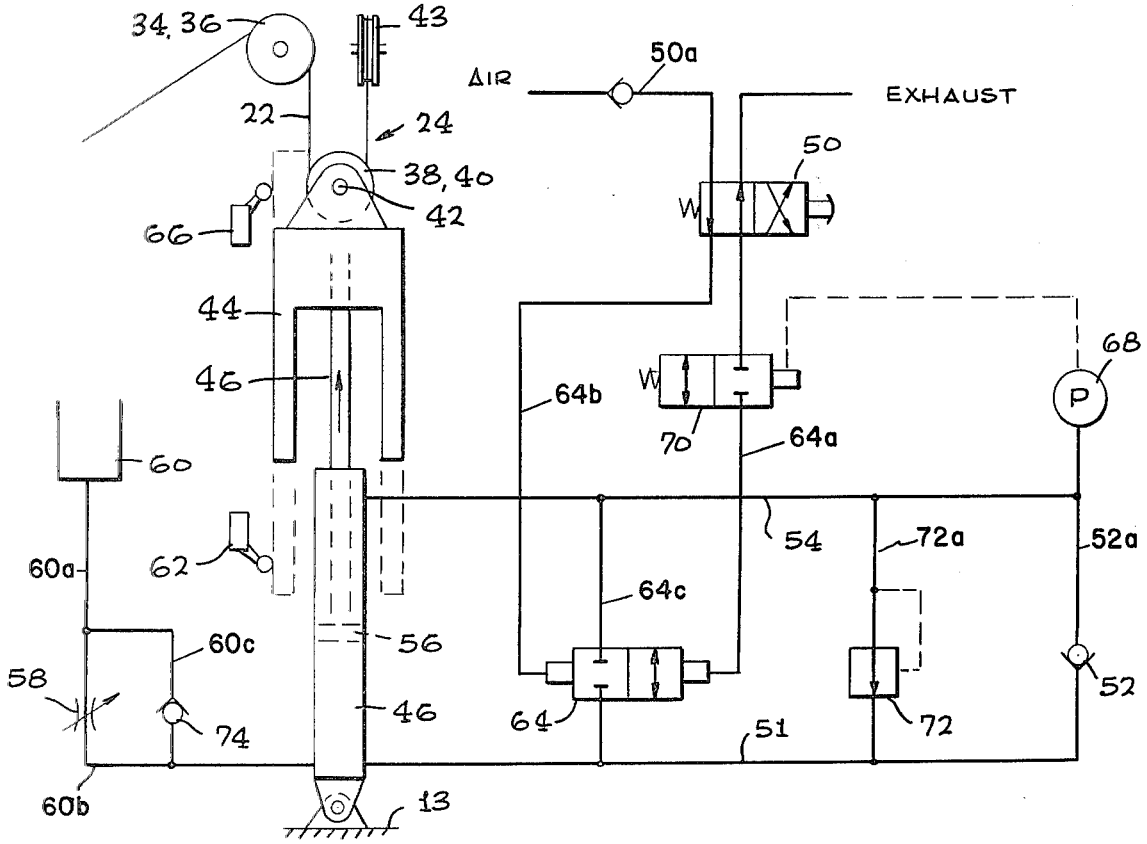

FIG. 6 is a schematic diagram of the motion compensation system and control system of FIG. 3 with the valves positioned to permit the piston pressure to be relieved as in the case of an overload.

DESCRIPTION OF THE PREFERRED EMBODIMENT

Figure 1:
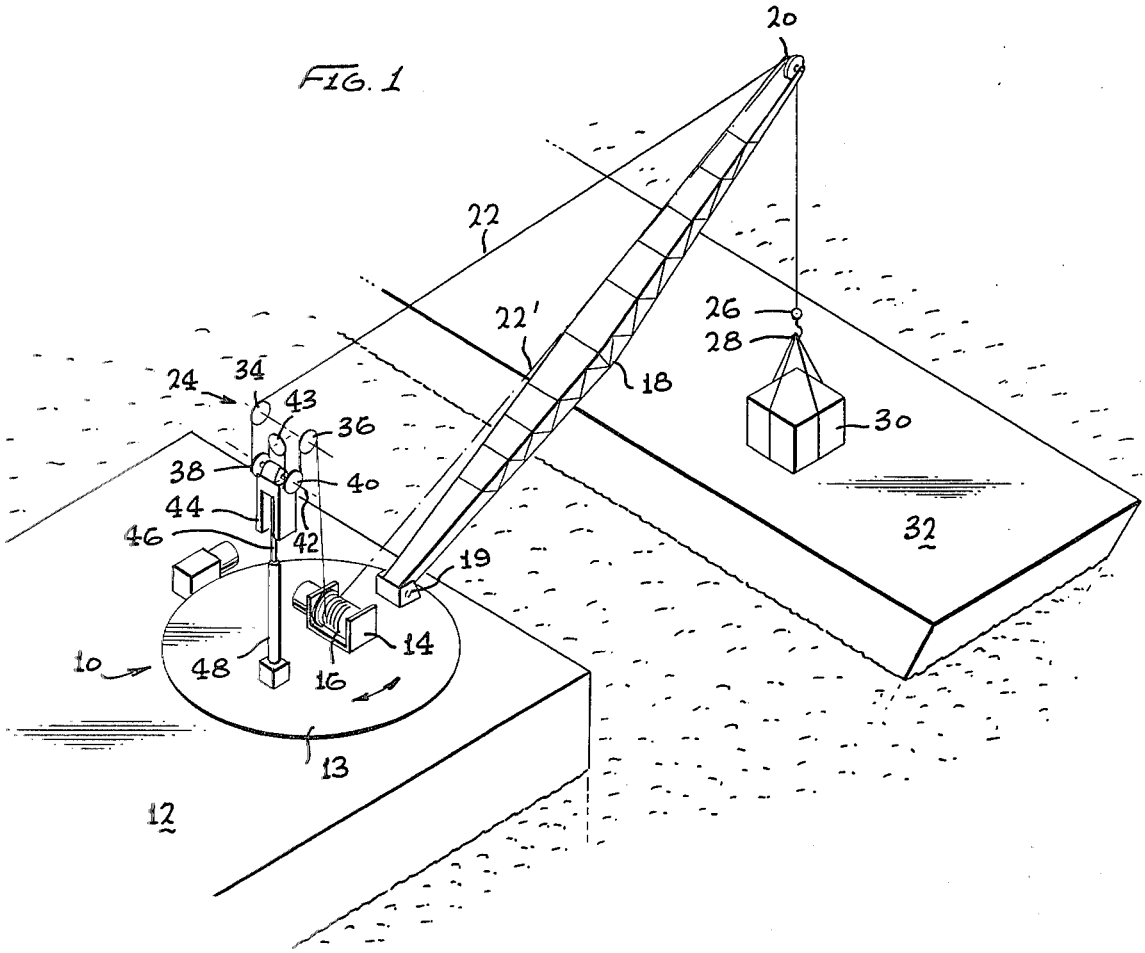
FIG. 1 is a perspective drawing of a crane hoist and a motion compensation system therefor according to my invention.

Referring now to FIG. 1, a crane hoist is shown generally at numeral 10 which is mounted on the deck of a moored semisubmersible platform 12. The crane hoist includes a rotatable machinery deck 13 supporting a winch 14 including a cable storage drum 16, a boom 18 pivoted at its mounting point 19 on the deck 13, having a sheave 20 at its outer end. A wire rope 22 is stored on the drum and reeved through a reeving system 24, over the sheave 20 at the end of boom 18 where it supports a headache ball 26 and load hook 28 from which is suspended a load 30 positioned on the deck of a work boat 32. An alternate conventional reeving arrangement is shown in dotted line at numeral 22' which can be employed when conditions do not require use of the motion compensator.

The reeving system 24 includes a pair of upper stationary sheaves 34, 36 which are preferably carried on the same axis, a pair of movable sheaves 38, 40 which are preferably carried on a common support means including axle 42 which is free to move up and down and an additional stationary sheave 43 which has its axis at 90 degrees with the axis of sheaves 34 and 36. It is the function of sheave 43 simply to redirect the wire rope 22 from sheave 40 to sheave 38 and vice versa. Secured to the axle 42 is a counterweight 44 fastened to the rod end 46 of a hydraulic ram or damping cylinder 48 attached to the deck of the crane hoist 10. It will be recognized that the crane 10 will also conventionally include an operator's station on its deck 13, preferably adjacent the winch 14. Such station has not been shown because it would tend to obscure the structure described above.

From the foregoing it will be recognized that the counterweight 44 imposes a load on axle 42 providing a continuous pre-tension on the wire rope 22. Thus, as the work boat 32 and load 30 rise and fall with wave action, the counterweight force acting through the reeving system 24 operates to remove any slack which might tend to develop in the wire rope 22. In this manner the crane hook will follow the heaving motion of the load 30 at a low level of pre-tension.

Figure 2:
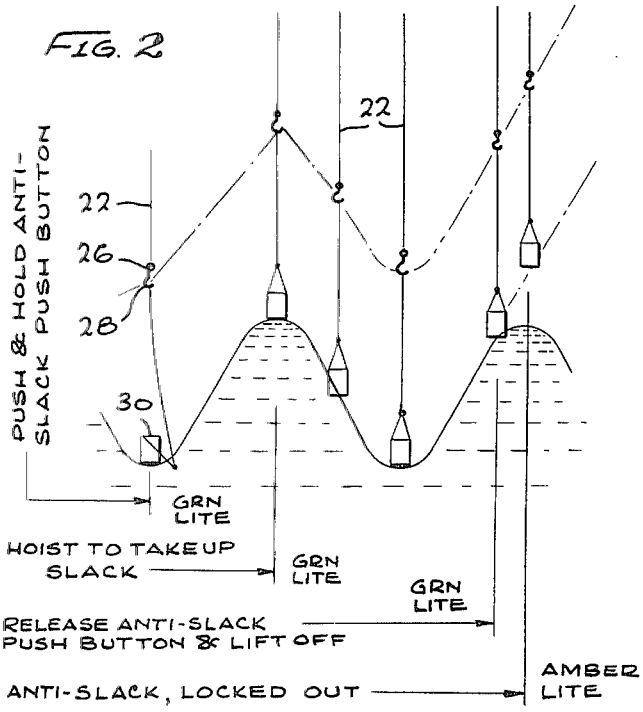
FIG. 2 is a graph indicating typical motion of a load which the compensation system of FIG. 1 must follow.

The nature of the operation of applicant's system is graphically illustrated by means of FIG. 2 in which the vertical movement may be considered to be shown vertically and time, horizontally. As shown at left, the load is at a low position reflecting a trough of a wave, the load hook 28 is extended, and there is slack in the lifting line attached to the load. At this point the green light is lighted and the operator pushes and holds the "ANTI-SLACK" pushbutton. In the next position shown (second from left), the load has reached a peak height on the crest of a wave and the lifting line has had the slack removed. In the third position, the work boat and load are essentially half way down the next wave from the crest, and this action plus that of the motion compensator continues to take all of the slack out of the lifting line. In the fourth position, the load has again reached the trough of the wave, and the motion compensator has kept the slack out of the lifting line. It continues to keep this pre-tension on the line as the load is again moved upward by wave action as shown in the fifth position. This point, while the load is already moving upwardly, is the best time to lift the load from the deck, and the operator should then release the anti-slack pushbutton and operate the winch to lift the load, causing it to continue upwardly even as the boat reaches the crest of the wave and starts to move downwardly again.

To assist the operator is knowing just when to release the anti-slack pushbutton to initiate the operation of the winch, applicant has provided the control system described in FIGS. 3–6. In FIG. 3 a normal condition of the system is portrayed in which there is no load on the hook and the anti-slack pushbutton valve 50 is released. The working fluid (hydraulic oil) is forced out of the head end of cylinder 48 by the counterweight 44 through a first conduit 51, a branch conduit 52*a* having a check valve 52, through a second conduit 54 into the rod end of the cylinder. Since the head end of the cylinder 48 has greater volume relative to the displacement of the piston 56 then the rod end, an additional flow to working fluid (oil) passes through dampening conduit 60*a* including a dampening branch line 60*b* having a choke valve 58 into an expansion tank 60. Choke valve 58 provides a dampening means limiting the rate of descent of the counterweight 44. As the counterweight approaches the bottom of its travel, it trips and maintains a limit switch 62 which illuminates a green "OK TO OPERATE ANTI-SLACK" light in the operator's control panel (see FIG. 3*a*).

With the anti-slack pushbutton valve 50 released, the load is placed on the hook in a normal manner and the hoist operated to take the slack out of the hoist wire and slings. At this same time, pushbutton valve 50 is activated and maintained as shown in FIG. 4. Power from the source "air" is conducted through line 50*a*, pushbutton valve 50, and line 64*a* to shift a block valve 64 in branch conduit 64*c* between first and second conduits 51 and 54 to allow oil to pass freely between the head end of the damping cylinder and the rod end. As the load on the deck of the work boat travels downward the hook 28 moves downward pulling the rope 22 with it. It results that the counterweight 44 is lifted and oil is forced out of the rod end of the damping cylinder through valve 64 into the head end of the damping cylinder. Oil from expansion tank 60 now flows through a one-way check valve 74 in dampening branch conduit 60*c* which is in parallel with dampening branch conduit 60*b* and also through choke valve 58 to provide the necessary additional volume required. If the operator has pulled in too much wire rope while taking up slack, the counterweight will trip and maintain a limit switch 66. This lights and maintains a red "WARNING LOWER HOOK" light (FIG. 3*a*). The operator then lowers the hook until the light goes out. As the load on the deck of the work boat travels upward, the counterweight maintains tension in the hoist wire and moves downward, forcing oil out of the head end of the cylinder through valve 64 into the rod end of the cylinder. Excess oil is passed through valve 58 into expansion tank 60. As the counterweight approaches the maximum down travel, it again trips and maintains limit switch 62. This lights and maintains the green "OK TO OPERATE ANTI-SLACK" light. This is an indication that the load on the deck of the work boat is moving upward and approaching the crest of the wave. At this time the operator releases the anti-slack pushbutton 50 connecting the source of power to block valve 64 through line 64*b* (FIG. 5). This shifts blocking valve 64, hydraulically locking the cylinder and counterweight. The operator immediately hoists the load which is moving upward and near the crest of a wave. The pressure in the rod end of the cylinder 48 immediately increases, activating a pressure switch 68 which shifts an override means such as valve 70. This lights the amber "ANT I-SLACK LOCKED OUT" light (FIG. 3*a*). If the operator inadvertently pushes the anti-slack pushbutton 50, valve 70 prevents valve 64 from shifting, thus maintaining the hydraulic lock.

If the operator misjudges and attempts to pick up the load when it is moving downward, and if this load would tend to introduce a shock load greater than the crane rating, pressure in the rod end of the cylinder will shift a relief valve 72 in branch conduit 72*a* between first and second conduits 51 and 54 (FIG. 6), allowing oil to pass to the head end of the cylinder. With the operator still hoisting and the counterweight moving upward, the downward movement of the load is gradually retarded and the overload dissipated in heat in the hydraulic oil. If the overload is due to a sustained load such as hooking the work boat, the counterweight will continue to travel upward until limit switch 66 is tripped. This will light the "WARNING LOWER HOOK" light. This gives the operator time to judge the situation and pay out wire on the hoist.

From the foregoing it will be understood that the compensation system described above is quite simple and straightforward in structure, is easily and readily operated by the crane operator, and includes features for protecting the crane from shock loads or other loads including those resulting from operator error which would otherwise overload the crane and possibly cause serious damage or loss to the crane, the load or possibly injury to personnel in the area.

While a single embodiment has been disclosed herein, it is recognized that those skilled in the art may make various modifications within the scope of the present invention.

I claim:

1. For use with a crane hoist for lifting a load including a platform, a rotatable machinery deck on said platform, a boom attached to said machinery deck, a sheave at the end of said boom, a hoist including a drum, a rope on said drum reeved over said sheave and a crane hook at the end of said rope for attachment to said load, a motion compensation system comprising:

a reeving system carrying said rope between said boom sheave and said drum;

said reeving system including stationary sheave means affixed to said machinery deck, support means, and sheave means mounted on said support means movable relative to said stationary sheave means;

a counterweight attached to said support means and urging said support means downwardly away from said stationary sheave means, thus taking up slack in said rope;

a hydraulic cylinder anchored to said machinery deck;

a piston in said cylinder and a rod connecting said support means to said piston;

and a control system for controlling operation of said hydraulic cylinder and piston including:

first and second fluid conduits connected to opposite ends of said cylinder;

branch conduits interconnecting said first and second conduits;

a check valve in one branch conduit permitting flow from the head end to the rod end of said cylinder while preventing flow from the rod end to the head end of said cylinder;

a blocking valve in another of said branch conduits in parallel with said check valve and when open permitting flow from the rod end to the head end of the cylinder and when closed preventing flow from the rod end to the head end of the cylinder;

said blocking valve including means for moving the blocking valve between open and closed positions;

a source of power for operating the control valve;

means connecting said source of power to said blocking valve;

anti-slack valve means located in said last mentioned connecting means for controlling the application of power to said blocking valve to shift the blocking valve between open and closed positions; and override means connected to the fluid conduit connected to the rod end of said cylinder and responsive to a selected pressure within the rod end of said cylinder overriding said anti-slack valve means and preventing movement of the blocking valve from closed to open position while pressure within the rod end of said cylinder exceeds said selected pressure due to the load on said rope.

2. A control system as in claim 1 wherein a third branch conduit interconnects said first and second conduit, and a pressure relief valve is provided in said third branch conduit permitting flow from the rod end to the head end of said cylinder in response to a selected high pressure in the rod end of said cylinder.

3. The control system of claim 1 or 2 wherein a dampening means is provided for preventing too rapid flow out of said head end of said cylinder.

4. The control system of claim 3 wherein the dampening means comprises, an expansion tank, a dampening conduit between said expansion tank and said head end of said cylinder, said dampening conduit including parallel branch lines, a check valve in one dampening conduit branch line preventing flow therethrough from the head end of the cylinder to the expansion tank, and a choke valve in a second dampening conduit branch line controlling the rate of flow from the head end of the cylinder into the expansion tank.

5. A motion compensation system as claimed in claim 1 or 2 wherein a first indicating means is provided indicating that the motion compensation system may be actuated and a first limit switch is included which responds to travel of said counterweight near the bottom of its travel to actuate said first indicating means.

6. A motion compensation system as claimed in claim 5 wherein a second limit switch is included which responds to travel of said counterweight near the top of its travel to actuate a second indicating means, said second indicating means warning of a need to pay out rope.

7. A motion compensation system as claimed in claim 3 wherein a first indicating means is provided indicating that the motion compensation system may be actuated and a first limit switch is included which responds to travel of said counterweight near the bottom of its travel to actuate said first indicating means.

8. A motion compensation system as claimed in claim 7 wherein a second limit switch is included which responds to travel of said counterweight near the top of its travel to actuate a second indicating means, said second indicating means warning of a need to pay out rope.

* * * * *